US008206596B2

(12) United States Patent
Wang et al.

(10) Patent No.: US 8,206,596 B2
(45) Date of Patent: Jun. 26, 2012

(54) MAGNETIC SEPARATION APPARATUS AND METHOD FOR RECOVERY OF SOLID MATERIAL FROM SOLID-LIQUID MIXTURE

(75) Inventors: Nongyue Wang, Shanghai (CN); Xiaogen Feng, Shanghai (CN); Xiaohui Mao, Shanghai (CN)

(73) Assignee: Jiangsu Sinorgchem Technology Co., Ltd., Taizhou, Jiangsu Province (CN)

( * ) Notice: Subject to any disclaimer, the term of this patent is extended or adjusted under 35 U.S.C. 154(b) by 957 days.

(21) Appl. No.: 12/224,030

(22) PCT Filed: Feb. 22, 2008

(86) PCT No.: PCT/CN2008/000387

§ 371 (c)(1),
(2), (4) Date: Aug. 13, 2008

(87) PCT Pub. No.: WO2009/103191

PCT Pub. Date: Aug. 27, 2009

(65) Prior Publication Data

US 2010/0228056 A1 Sep. 9, 2010

(51) Int. Cl.
*B03C 1/02* (2006.01)

(52) U.S. Cl. ..... 210/695; 210/142; 210/222

(58) Field of Classification Search ..... 210/695, 210/141, 222, 223, 142
See application file for complete search history.

(56) References Cited

U.S. PATENT DOCUMENTS

| | | | | |
|---|---|---|---|---|
| 1,390,688 A | | 9/1921 | Ellis | |
| 2,348,418 A | | 5/1944 | Roesch et al. | |
| 3,010,915 A | | 11/1961 | Buell et al. | |
| 4,021,367 A | | 5/1977 | Gal et al. | |
| 4,124,503 A | * | 11/1978 | Watson | 210/695 |
| 4,444,659 A | * | 4/1984 | Beelitz et al. | 210/222 |
| 5,076,914 A | * | 12/1991 | Garaschenko et al. | 210/222 |
| 5,171,424 A | | 12/1992 | Hettinger | |
| 5,190,635 A | | 3/1993 | Hettinger | |
| 5,538,624 A | | 7/1996 | Hettinger | |
| 5,834,197 A | * | 11/1998 | Parton | 210/222 |
| 6,099,739 A | * | 8/2000 | Kobayashi | 210/695 |

FOREIGN PATENT DOCUMENTS

| | | |
|---|---|---|
| CN | 1172750 | 3/2002 |
| CN | 02106745.7 | 3/2002 |
| CN | 1397374 A | 2/2003 |
| CN | 1433839 A | 8/2003 |
| JP | 2006102625 A | 4/2006 |

* cited by examiner

*Primary Examiner* — David A Reifsnyder

(74) *Attorney, Agent, or Firm* — Manni Li; Mei & Mark LLP

(57) ABSTRACT

The present invention relates to a magnetic separation apparatus for continuous separating and recovering magnetic solid particles from a solid-liquid mixture. The apparatus includes at least one magnetic separation unit and each unit includes: an outer cylindrical vessel having a material inlet, a first outlet, and a second outlet; an inner cylindrical vessel, at least part of which extends along the axis inside the first cylindrical vessel without contacting with the inner surface of the outer cylindrical vessel; and a magnet, rendering the bottom of the inner cylindrical vessel magnetism during the first period and making the part of the surface lose its magnetism during a second period. When the solid-liquid mixture flows through the magnetic surface of the inner cylindrical vessel in the passage, the magnetic solids are absorbed and separated from the mixture.

24 Claims, 2 Drawing Sheets

MAGNETIC SEPARATION APPARATUS AND METHOD FOR RECOVERY OF SOLID MATERIAL FROM SOLID-LIQUID MIXTURE

RELATED APPLICATION

The subject application is a PCT national stage of PCT/CN2008/000387 filed on Feb. 22, 2008 in China, contents of which are incorporated herein by reference.

TECHNICAL FIELD

The present invention relates to an apparatus for recovery of solid materials from solid-liquid mixture through magnetic separation, and a method of separating magnetic particles for recovery of solid materials from solid-liquid mixture.

BACKGROUND OF THE INVENTION

Methods for separating solid particles from a liquid mixture based on their magnetism or magnetization have been known. For examples, U.S. Pat. No. 3,010,915 discloses magnetic separation of a reduced nickel-kieselguhr catalyst through a magnetic separation zone. U.S. Pat. No. 5,190,635 discloses a separation method of more magnetically active, older, less catalytically active particles from the selective, higher metals-containing catalytic particles, and a rare earth roller-belt magnetic separation unit operates on a side stream of the catalysts. U.S. Pat. No. 4,021,367 discloses separating magnetic nickel catalyst through a continuously moving magnetic field produced with at least two discs rotating on a common shaft and immersed into the liquid suspension, and the collected magnetic catalyst is removed by slanted doctor blades.

Magnetic or magnetizable ingredients have been added to the solid particles to add the magnetism and facilitate their subsequent removal from or retention in the liquid mixture. U.S. Pat. No. 5,171,424 discloses continuously adding one or more heavy rare earth additives as the magnetic hook to the reaction feedstock so that they accumulate on aged catalyst and facilitate the removal of aged catalyst by a magnetic roller belt separator. U.S. Pat. No. 5,538,624 discloses selective magnetic retention of high-cost specialty additives by incorporating into the additives selective magnetic moieties including manganese, heavy rare earth oxidation, and superparamagnetic iron to facilitate their retention and recovery of the additives through a roller belt magnetic separator.

Apparatus for magnetic separation has been known for ages. The roller belt magnetic separator has been used to separate aged fluid catalytic cracking (FCC) catalysts. U.S. Pat. No. 1,390,688 discloses passing liquid through inclined aluminum plates in a magnetic zone to accomplish the magnetic separation of nickels therefrom. U.S. Pat. No. 2,348,418 discloses a magnetic separator having a revolving iron magnetic armature surrounded by field core; the magnetic catalysts are collected on the armature and removed by scraper, and discharged.

The above-mentioned methods of separation are burdensome, and the apparatus does not operate efficiently. These prior separation processes need to be interrupted to collect the recovered magnetic material, and then resumed after the batch collection. Thus, the time for recovery is prolonged, and the rate of recovery or removal is correspondingly reduced.

Chinese Patent No. 02106745.7 discloses a permanent magnetic pair-rollers separator for continuous separation of magnetic particles. The magnetic particles in liquid material are collected and released through rolling of round pair-rollers with same diameter. Since the liquid material touches dam-board firstly after it enters rectangular case and then flows to the rollers on the left and right side for collecting and there is no fixed discharge pipeline, the flowing direction of the liquid after separation is hard to be controlled. The efficiency of separation is relatively low, which influences the continuity of the reaction.

SUMMARY OF THE INVENTION

Magnetic solid material, especially powdery magnetic catalyst, has the characteristics of large relative surface area, high catalytic activity, and its continuous use and recovery would significantly reduce the environment pollution and cost.

The present invention provides a magnetic separation apparatus for continuous separation and recovery of magnetic solid particles from solid-liquid mixture.

The magnetic separation apparatus of the present invention has at least one unit for magnetic separation, and each unit has an outer cylindrical vessel having an inlet, a first outlet, and a second outlet; an inner cylindrical vessel, at least part of which extends coaxially inside the outer cylindrical vessel without contacting the inner wall of the outer cylindrical vessel, thus forming a flow channel between the inlet and the first outlet; and a magnet, which may magnetize at least part of the surface of the inner cylindrical vessel during a first period and demagnetize the same during a second period. Preferably, the inlet is in close proximity to the magnetizable area of the inner cylindrical vessel.

In one embodiment, the part of the inner cylindrical vessel extending coaxially inside the outer cylindrical vessel does not make any contact with the bottom of the outer cylindrical vessel, while the magnetized area of the inner cylindrical vessel includes the bottom thereof. The second outlet is at the bottom of the outer cylindrical vessel for discharging magnetic solid particles after separation.

In the present invention, preferably, a distance is preset between the inlet and the first outlet so that a liquid containing magnetic solid particles has enough retention time in the outer cylindrical vessel for the magnetic particles to be absorbed onto the magnetic surface of the inner cylindrical vessel.

In one embodiment, the magnet is an electromagnet, which renders at least part of the surface of the inner cylindrical vessel magnetic during a first period and causes the same part of the surface to lose magnetism during a second period.

In another embodiment, the magnet is a permanent magnet, which resides inside the inner cylindrical vessel and moves to a first position near the bottom of the inner cylindrical vessel in a first period and to a second position away from the bottom of the inner cylindrical vessel in a second period.

The magnetic separation apparatus of the present invention may further comprise a settler which seals at least the lower portion of the magnetic separation unit and has an outlet for discharging solid material. The settler may accommodate multiple magnetic separation units in parallel. Preferably, when some of the magnetic separation units have the inner cylindrical vessels being magnetized and their flowing paths open, other units have the inner cylindrical vessels being demagnetized and the flowing paths closed.

The present invention further provides a method for separating and recovering magnetic solid particles from the solid-liquid mixture, having the steps of passing the solid-liquid mixture through at least one vessel of multiple vessels in parallel, each vessel having a magnetism alternating device; absorbing magnetic solid particles in the solid-liquid mixture by the at least partially magnetic surface of the magnetism alternating device during a first period; releasing the magnetic solid particles by demagnetizing the at least partially magnetic surface of the magnetism alternating device during a second period; passing the released magnetic solid particles through an outlet under the condition of non-magnetism. The first time period and the second time period alternate periodically. The first and second period are periodically alternated, and the ratio is about 1-20:1.

In the present invention, the magnetic solid particles have particle size of 40 to 300 mesh. The flow velocity of the solid-liquid mixture in the vessel is 0.001-2 m/s. The content of the magnetic solid particles in the solid-liquid mixture is 0.01-30% (W/W).

In the present invention, the solid-liquid mixture may contain magnetic and non-magnetic solid particles. The magnetic solid particles may contain ferromagnetism or superparamagnetism ingredients. The magnetic solid particles may be a powdery composite catalysts containing nickel, aluminum, and other metals or nonmetals.

In one embodiment, the content of nickel is 25-99.9%; the content of aluminum and other metals or nonmetals are 0.1-75%. The metals or nonmetals may be one or more of Fe, Cu, Cr, Co, Mn, Mo, B, and P.

In one embodiment, multiple vessels are used, and when the magnetism alternating device of some vessels are magnetic and the flow channels are open, the rest of the devices are non-magnetic and the flow channels are closed.

The present invention further provides a method for continuously recovering magnetic solid particles from a reaction system, having the steps of continuously passing a reaction mixture through a vessel having a magnetism alternating device; absorbing magnetic solid particles in the reaction mixture by the at least partially magnetic surface of the magnetism alternating device during a first period; releasing the magnetic solid particles by demagnetizing the at least partially magnetic surface of the magnetism alternating device during a second period; passing the released magnetic solid particles through an outlet at the bottom of the vessel under the condition of non-magnetism. The method may be applicable to any continuous reactions, including but not limited to, liquid-solid reaction or gas-liquid-solid three phase reaction, for examples, hydrogenation reaction, oxidation reaction, dehydrogenation reaction, solid acid-base catalytic reaction, and phase transfer catalytic reaction.

The present invention also provides a reaction system comprising a magnetic separation apparatus which contains at least one magnetic separation unit. Each magnetic separation unit includes an outer cylindrical vessel having an inlet, a first outlet, and a second outlet; an inner cylindrical vessel, at least part of which extends coaxially inside the outer cylindrical vessel, and the part extending inside the outer cylindrical vessel makes no contact with the inside wall of the outer cylindrical vessel; a magnet, which may render at least part of the surface of the inner cylindrical vessel magnetic during a first period and demagnetizes the same part of the surface during a second period, while the inlet is in close proximity to the magnetizable area of the inner cylindrical vessel.

During the operation of the apparatus of the present invention, each step may be continuously conducted, and the magnetic materials may be continuously recovered and recycled without interruption for separation and recycle.

DETAILED DESCRIPTION OF THE INVENTION

Figure 1:
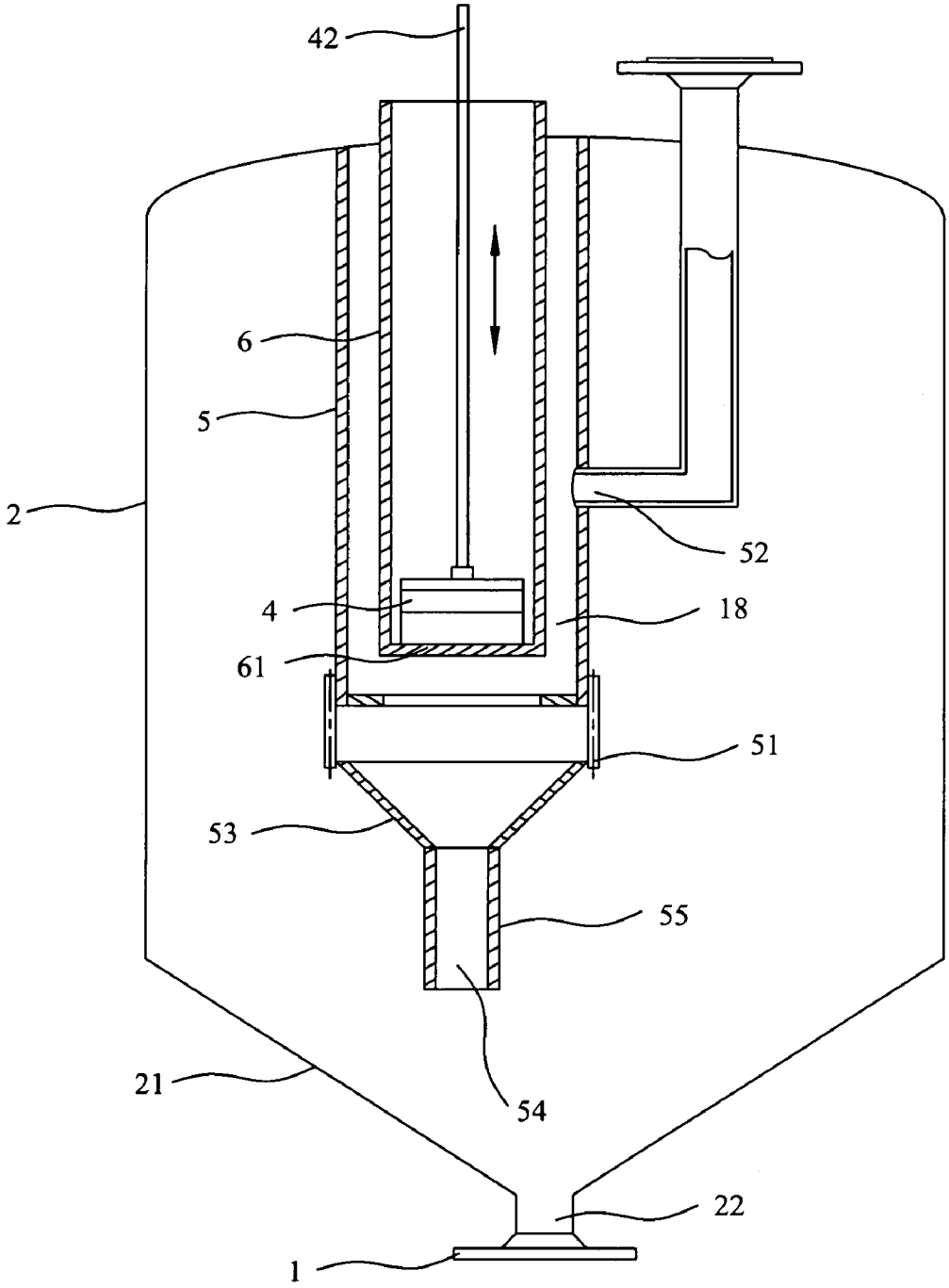
FIG. 1 shows the magnetic separation apparatus of the present invention.

FIG. 1 is a sectional view of one embodiment of the magnetic separation apparatus of the present invention. The magnetic separation apparatus has an outer cylindrical vessel 5 and an inner cylindrical vessel 6, and the inner cylindrical vessel 6 is inside the outer cylindrical vessel 5 and extending coaxially through the outer cylindrical vessel so that the cross sections of the inner and outer cylindrical vessel form basically concentric circles. In other words, a circular channel 18 is formed between the inner and outer cylindrical vessels, and liquid may flow within the channel. A magnet 4 is inside the inner cylindrical vessel 6, which renders the bottom of the inner cylindrical vessel magnetic. A first outlet 52 is located at the upper portion of the outer cylindrical vessel 5 so that liquid may flow out after the magnetic particles are separated therefrom. The outer cylindrical vessel 5 has a cone-shaped bottom 53 having a second outlet 54 at the lowest tip for allowing the discharge of magnetic particles. An inlet 51 is located close to the bottom of the outer cylindrical vessel and above the cone-shaped bottom.

The magnet 4 inside the inner cylindrical vessel may be a permanent magnet or an electromagnet. When being a permanent magnet, it periodically moves up and down inside the inner cylindrical vessel 6. When it moves to a first position near the bottom plate 61 of the inner cylindrical vessel, the bottom plate 61 is magnetized, and thus capable of absorbing magnetic particles in the mixture that enter from the inlet 51 of the outer vessel and passes through the bottom plate 61; when it moves to a second position away from the bottom plate 61 of the inner cylindrical vessel, the bottom plate 61 loses magnetism. At this time, the magnetic particles are released from the bottom plate and settle down to the cone-shaped bottom 53, and are discharged through the second outlet 54. When the magnet is an electromagnet, the electricity may be supplied to the electromagnet alternately so that the magnetism of the electromagnet is turned on and off.

The permanent magnet used in the apparatus of the present invention may be of ferrite or rare earth permanent magnetic material.

Figure 2:
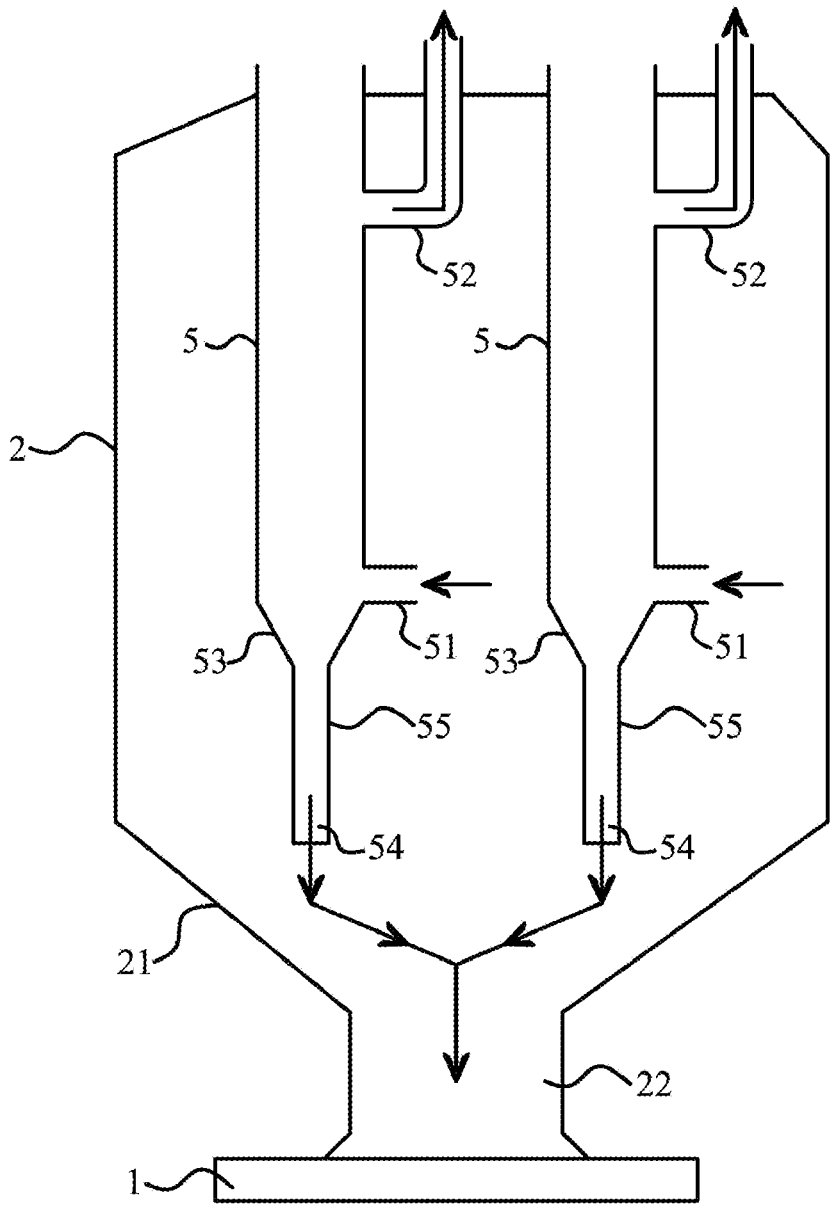
FIG. 2 shows that multiple magnetic separation units in parallel and magnetic particles are collected by a settler according to the present invention.

Further, the outside of the outer cylindrical vessel 5 is covered by a housing 2, and the bottom of the housing 2 has a cone-shaped bottom 21 for collecting and facilitating the deposition of magnetic solid material as a settler. The cone-shaped portion 21 covers at least the cone-shaped receiving plate 53 of the outer cylindrical vessel 5. As shown in FIG. 2, multiple magnetic separation units 5 are arranged in parallel inside the housing of the settler 2. Practically, the present invention may provide multiple outer cylindrical vessels, for example, 1~10 outer cylindrical vessels 5, which operate simultaneously to separate and slowly release the recovered magnetic material through their outlets 54 which then enter the cone-shaped bottom 21 of the settler 2. The magnetic material is collected and recovered after passing through the outlet 22 of the cone-shaped portion 21 of the bottom portion 1 of the settler.

When the reaction mixture containing magnetic material or magnetic catalyst enters the vessel from the inlet 51, the reaction mixture overflows upwards and passes through the circular channel 18 between the outer 5 and inner cylindrical vessel 6, allowing magnetic solid material absorbed at the lower surface 61 of the inner vessel 6 without leaving the vessel with the mixture, thus, the magnetic solids and liquid mixture are separated, and the liquid mixture leaves the vessel via outlet 52 after separation of the magnetic solids. The settler 2 may form a closed system to prevent any gas from leaking. Therefore, the apparatus may be used not only to the continuous solid-liquid two phrase reaction but also to the reaction where gas phase is involved.

Practically, the magnetic particles do not absorb onto the surface of the magnetic surface of the cylindrical vessel permanently. When the magnet 4 is a permanent magnet, it moves up and down rapidly, and at most of time, it is located at the first position near the bottom plate 61 of the inner cylindrical vessel (as indicated in FIG. 1) to render magnetism to the bottom plate for the separation of magnetic particles from liquid mixture. When too much magnetic particles are absorbed on the outer surface of the bottom plate 61 such that the efficiency of the separation is reduced, the magnet is pulled by the pull rod 42 to move upward to the second position away from the bottom plate 61 (not shown) which reduces the absorption on the magnetic particles, then, due to gravity, the solid particles settle into the cone-shaped bottom 53. Then, the solid particles settle into the lower cone-shaped portion 21 of the settler 2 along the pipe 55. The cone-shaped portion helps reduce the accumulation of the magnetic solid particles.

The present invention further provides a method for separating solid materials from a solid-liquid mixture having the steps of passing the solid-liquid mixture containing magnetic solids through a vessel having a portion that is in an alternate state of magnetism and non-magnetism, absorbing the magnetic solids on the portion in the state of magnetism, and releasing the retained magnetic solids from the portion to an outlet at the bottom of the vessel in the state of non-magnetism.

As the state of magnetism and non-magnetism of the portion of the vessel may be altered periodically, the absorption and release of magnetic particles on the bottom surface of the magnetic portion occur alternately and periodically. The time period for the portion in magnetism and non-magnetism is about (1-20):1 in ratio. Generally, the change of the period time may be determined according to the mixture and recovery ratio of the magnetic particles. The magnet may be a permanent magnet or an electromagnet. For the permanent magnet, the change in absorption force may be realized by the reciprocating movement of the magnet as shown in FIG. 1, and the time ratio of the magnet being at the lower point (the first position) to the higher point (the second position) is about (1-20):1. For the electromagnet, the magnetic force may be controlled by turning on or off the electricity so that the recovery of the magnetic catalysts may be controlled. Preferably, the time period during which the bottom of the inner cylindrical vessel is in the state of magnetism is much longer than when it is in the state of non-magnetism to fully separate the magnetic particles from the liquid. For example, the time ratio may be controlled at (5-20):1, more preferably, (10-20):1, and most preferably, (15-20):1.

In another embodiment, the aforementioned time ratio may be (1-5):1, such as 1:1. Under such condition, multiple units having the inner and the outer cylindrical vessels are installed in parallel in the settler 2. A proper circuit design may allow that when some units have the inner cylindrical vessels magnetized for absorption of magnetic particles with open flowing paths, other units are in the state of non-magnetism for releasing magnetic particles from the surface of inner cylindrical vessels with the flowing paths closed to facilitate the sedimentation of the particles. Thus, the continuous magnetic separation is realized in the whole apparatus. Under such condition, longer time for sedimentation is allowed (when the absorbed magnetic particles begin to settle down as soon as the surface of the inner cylindrical vessel loses magnetism.), and the magnetized area of the inner vessel is not limited to the bottom, but part or all of the cylindrical surface near the bottom of the inner cylindrical vessel. The electrical circuit may be designed such that separate valves control their respective flowing paths in each unit, and simultaneous operation of the valves is realized through the control of a proper common chip. Preferably, the magnet of the present invention is an electromagnet, and the electricity supply thereto is controlled by the chip.

Preferably, the electromagnet is used in the present invention, as it is easy to automate the operation and precisely control the action without any mechanical wear.

The solid-liquid mixture may continuously pass through the magnetic portion of the vessel (such as the inner cylindrical vessel 6) which continuously alternates between the state of magnetism and non-magnetism, and the magnetic solids are periodically absorbed and released from the outer surface of the vessel without any interruption of the continuous flow of the solid-liquid mixture. Therefore, the process of the present invention is a continuous process, with the magnetic particles being continuously separated and recovered from the solid-liquid mixture. The process of the present invention is particularly suitable for industrialized production for a continuous process, allowing continuous flow and recovery of materials.

In the present invention, one of the ordinary skill in the art may select the parameters of the density of the magnetism field, flow rate of the liquid mixture, and the strength of the magnetic attraction between the magnetic solid materials and the magnet to determine suitable conditions for the recovery of the magnetic particles.

Any solid particles with a suitable size that may pass the flow channel may be recovered without affecting the catalytic activity or reactivity thereof. Preferably, the magnetic solids may have a particle size of about 40 to 300 mesh. If the mesh of the particles is too big, it is easy for the particles to flow away with the liquid and difficult to deposit. If the mesh is too small, the relative surface area of the particles is too big such that they form a suspension on the surface of the liquid medium and their deposition is easily affected by the liquid flow, resulting in decreased efficiency of recovery.

When the flow rate of the material is too high, the solid particles will easily flow away with the material. When the flow rate of the materials is too low, the output is reduced. Preferably, the flow rate for the material may be about 0.001 to 2 msec.

The density of the magnetic field is selected such that the magnetic particles may by absorbed and deposed due to their gravity. The material entering the vessel has a solid to liquid ratio of 0.01% to 30% (W/W), and the ratio of un-recovered magnetic particles is less than 0.3% wt.

The solid-liquid reaction mixture may contain both magnetic and non-magnetic solid particles, and the magnetic solids may be particles having magnetic ingredient. The magnetic ingredient may be ferromagnetic or superparamagnetic and may be incorporated into the solid particles through known techniques. Exemplary methods include i) impregnating the solid particles in a solution containing the magnetic material, ii) spraying onto the solid particles, or iii) through a mixing and sintering process while making the alloy solid particles. Particularly, the magnetic ingredient is distributed relatively uniformly throughout the solid particles so that all particles are rendered magnetism or superparamagnetism.

Suitable magnetic or superparamagnetic ingredient may have catalytic activity of itself or participate in the reaction as a reactant, or may be incorporated into catalytic or reactive solid particles solely for the purpose of rendering magnetism. Examples of magnetic ingredients that may be used include: iron, nickel, copper, heavy rare earth additives including Gadolinium, Terbium, Dysprosium, Holmium, Erbium, and Thorium, Antimony, Manganese, Aluminum, Barium, Calcium, Oxygen, Platinum, Sodium, Strontium, Uranium, Magnesium, Technetium, Nickel Oxide, $FeOFe_2O_3$, $NiFe_2O_3$, $CuOFe_2O_3$, MnBi, MnSb, $MnOFe_2O_3$, $Y_3Fe_5O_{12}$, $CrO_2$, MnAs, and EuO.

When the catalyst to be separated is a hydrogenation catalyst, the magnetic solid material, preferably, is a powdery composite catalyst comprising nickel, aluminum, and other metal or nonmetal.

Preferably, the powdery composite catalyst contains 25-99.9% nickel and 0.1-75% aluminum and other metal or nonmetal.

More preferably, the metal and nonmetal in the powdery composite catalyst may be Fe, Cu, Cr, Co, Mn, Mo, B, or P. Most preferably, at least Fe is added to adjust the ferromagnetism of the powdery composite catalyst.

The method of the present invention may apply to, but not limited to, the solid-liquid two phase continuous reaction and solid-liquid-gas three phase continuous reaction.

The continuous reactions include, but not limited to, oxidation, hydrogenation, dehydrogenation, solid acid-base catalytic reaction, and phase transfer catalytic reaction.

The following example of hydrogenation reaction of 4-nitosodiphenylamine and/or 4-nitrodiphenylamine and/or their salts illustrates the apparatus and method of the present invention.

The following examples illustrate the present invention but not serve to limit the scope of the present invention.

Example 1

Production of Powdery Composite Catalyst

A powdery catalyst for hydrogenation is prepared from 46 g of powdery nickel, 51 g of powdery aluminum, and 3 g of powdery iron. They are homogenously mixed and molten into an alloy state in an induction furnace. The molten alloy is ejected by gas pressure via a nozzle to a copper drum rotating at a high speed, and then quenched quickly (with cooling speed of $10^5$-$10^6$K/sec). The cooled alloy is pulverized using a ball mill, and 99.7 g powder at 40 to 300 mesh are obtained by sieving. Aqueous solution of sodium hydroxide at 375 g and 20 wt % is added to a 500 ml three-necked flask equipped with a thermometer and a stirrer, and the powder is slowly added to the flask. The mixture is treated at 60° C. for 4 hours, then washed with deionized water until neutral to give the powdery composite catalyst.

Hydrogenation Reaction

The outlet 22 for recovered magnetic particles is linked to a Venturi type solid-liquid conveying device through a flange so that recovered magnetic particles are controllably conveyed back to the reactor. The filtrated condensation liquid containing 4-nitosodiphenylamine and/or 4-nitrodiphenylamine and/or their salts is conveyed into a first stage hydrogenation reactor equipped with a sealed magnetic stirrer and a heating and cooling system. Hydrogen is used to replace the air in the reactor and pressurized to 1.3 MPa. A hydrogen gas circulator maintains the flow rate of the circulating hydrogen gas at 1 $Nm^3$/hr. The circulating hydrogen gas is bubbled into the hydrogenation reactor. The condensation liquid and methanol liquid are conveyed into the hydrogenation reactor respectively, and the powdery composite catalyst from the above step is added. The hydrogenation liquid flows from the first stage reactor conversely to the second and third stage reactor at a temperature of 75-80° C. and retention time of 5 hours. After hydrogenation, the powdery composite catalyst is dispersed and carried away in the hydrogenation liquid which is discharged from the third stage reactor to the magnetic separation apparatus through inlet 51. The apparatus is made up of 3 magnetic separation units (each including an inner cylindrical vessel and an outer cylindrical vessel). The flow rate of the solid-liquid mixture is 1.5 m/s. The ratio of solid to liquid of magnetic powdery composite catalyst is 5% (W/W). The time period of the permanent magnet in the low position and above low position is 10:1 in ratio. The ratio of un-recovered powdery composite catalyst is 0.2%. Most of the recovered powdery composite catalyst is collected in the bottom 1 of the cone-shaped portion of the magnetic separation apparatus and conveyed back to the first stage hydrogenation reactor through an inlet pipe of the Venturi type solid-liquid mixture conveying device. The hydrogenation liquid discharged from the first outlet is analyzed by a high performance liquid chromatograph (HPLC) which contains no 4-nitosodiphenylamine and/or 4-nitrodiphenylamine and/or their salts. The recovered powdery composite catalyst is continuously recycled and reused for 11 times, and there is still no 4-nitosodiphenylamine and/or 4-nitrodiphenylamine and/or their salts found in the hydrogenation liquid.

Example 2

An iron particles having a particle size of 40 to 300 mesh are dispersed in a liquid mixture. The solid-liquid mixture enters the magnetic separation apparatus of the present invention. The iron powdery particles are continuously recovered through magnetic separation and sedimentation, and collected at the outlet of the vessel for recycle and reuse.

Example 3

Nickel magnetic particles having a particle size of 100 to 300 mesh are dispersed in a liquid mixture. The solid-liquid mixture enters the magnetic separation apparatus of the present invention. The nickel particles are continuously recovered through magnetic separation and sedimentation, and collected at the outlet of the vessel for reuse.

The invention claimed is:

1. An apparatus for magnetic separation of solid material from solid-liquid mixture, comprising at least one magnetic separation unit, and the magnetic separation unit comprising:

an inner cylindrical vessel having an inner surface, an outer surface, and a bottom portion, wherein the bottom portion of the inner cylindrical vessel is magnetizable and comprises a bottom plate, an outer cylindrical vessel having an inner surface, an outer surface, an inlet, a first outlet, a second outlet, an upper portion, and a bottom portion, wherein the bottom portion comprises a cone-shaped receiving plate for collecting solid material from the bottom portion of the inner cylindrical vessel, and the cone-shaped receiving plate is connected to the second outlet for discharging the solid material via a pipe; the inlet is located at the bottom portion above the cone-shaped receiving plate; the first outlet is at the upper portion of the outer cylindrical vessel; and a flow channel is formed between the inlet and the first outlet, and a magnet within the inner cylindrical vessel, wherein the magnet renders the bottom portion of the inner cylindrical vessel magnetized during a first period and demagnetized during a second period, and wherein at least part of the inner cylindrical vessel extends coaxially inside the outer cylindrical vessel and makes no contact with the inner surface of the outer cylindrical vessel; the bottom portion of the inner cylindrical vessel is in close proximity to the inlet.

2. The magnetic separation apparatus of claim 1, wherein the inner cylindrical vessel makes no contact with the bottom portion of the outer cylindrical vessel.

3. The magnetic separation apparatus of claim 1, wherein a distance is preset between the first outlet and the inlet.

4. The magnetic separation apparatus of claim 1, wherein the magnet is an electromagnet or a permanent magnet.

5. The magnetic separation apparatus of claim 4, wherein the permanent magnet is of ferrite or rare earth permanent magnetic material.

6. The magnetic separation apparatus of claim 1, further comprising a settler having a bottom portion formed of a cone-shaped receiving plate and a magnetic material outlet under the magnetic separation unit for discharging solid materials.

7. The magnetic separation apparatus of claim 6, comprising multiple magnetic separation units in parallel, and the settler under the magnetic separation units, wherein the settler collects solid material discharged from the second outlets of the multiple magnetic separation units.

8. The magnetic separation apparatus of claim 7, wherein the inner cylindrical vessels of a number of the multiple magnetic separation units are magnetized and their flow pathways are open, while the inner cylindrical vessels of remaining multiple magnetic separation units are demagnetized and their flow pathways are closed alternating.

9. The method for separating and recovering magnetic solid particles from a solid-liquid mixture by using the apparatus as described in claim 1, comprising the steps of passing a solid-liquid mixture through the inlet of the outer cylindrical vessel of the at least one magnetic separation unit, absorbing magnetic solid particles in the solid-liquid mixture to the magnetized bottom portion of the inner cylindrical vessel of the magnetic separation unit during a first period, releasing the absorbed magnetic solid particles from the bottom portion of the inner cylindrical vessel during a second period when the bottom portion of the inner cylindrical vessel is demagnetized, discharging the magnetic solid particles through the second outlet at the bottom portion of the outer cylindrical vessel of the magnetic separation unit, and removing the solid-liquid mixture by overflowing through the first outlet on the upper portion of the outer cylindrical vessel.

10. The method of claim 9, wherein the first period and the second period alternates periodically at about 1-20:1 in ratio.

11. The method of claim 9, wherein size of the magnetic solid particles is in a range of about 40-300 mesh.

12. The method of claim 9, wherein flow rate of the solid-liquid mixture in the magnetic separation unit is about 0.001 m-2 m/s.

13. The method of claim 9, wherein content of magnetic solid particles in the solid-liquid mixture is about 0.01-30 wt %.

14. The method of claim 9, wherein percentage of magnetic solid particles not being recovered is lower than 0.3 wt %.

15. The method of claim 9, wherein the magnetic solid particles in the solid-liquid mixture are ferromagnetic or superparamagnetic.

16. The method of claim 9, wherein the magnetic solid particles are powdery composite catalysts comprising Nickel, Aluminum, and other metal or nonmetal.

17. The method of claim 16, wherein content of Nickel is about 25-99.9% and contents of Aluminum and other metal or nonmetal is about 0.1-75%.

18. The method of claim 16, wherein the metal or nonmetal is one or more of Fe, Cu, Cr, Co, Mn, Mo, B, or P.

19. The method of claim 9, wherein multiple magnetic separation units are used, and when some units are magnetic and the flow paths are open, other units are demagnetized and the flow paths are closed.

20. The method for continuously recovering magnetic solid particles from a reaction system by using the apparatus as described in claim 1 comprising steps of continuously passing a reaction mixture through an inlet of the outer cylindrical vessel of the magnetic separation unit which is magnetized on the bottom portion of the inner cylindrical vessel during a first period and is demagnetized at the bottom portion of the inner cylindrical vessel during a second period, continuously absorbing the magnetic solid particles in the reaction mixture on the bottom portion of the inner cylindrical vessel during the first period, continuously releasing the absorbed magnetic solid particles from the bottom portion of the inner cylindrical vessel during the second period, continuously discharging the magnetic solid particles through the second outlet at the bottom portion of the outer cylindrical vessel of the magnetic separation unit, and continuously removing the reaction mixture from the magnetic separation unit by overflowing through the first outlet on the upper portion of the outer cylindrical vessel.

21. The method of claim 20 applied in continuous reactions including two-phase liquid-solid reaction and three-phase gas-liquid-solid reaction.

22. The method of claim 20 applied in hydrogenation, oxidation, dehydrogenation, solid acid-base catalytic reaction, or phase transfer catalytic reaction.

23. The method of claim 22, wherein the hydrogenation reaction is hydrogenation of 4-nitosodiphenylamine, 4-nitrodiphenylamine, or their salts.

24. A reaction system comprising the apparatus for magnetic separation of solid material from solid-liquid mixture as described in claim 1.

* * * * *